US005966779A

United States Patent [19]

Salice

[11] Patent Number: 5,966,779

[45] Date of Patent: Oct. 19, 1999

[54] BASE PLATE FOR FIXING A FURNITURE HINGE OR THE LIKE

[75] Inventor: Luciano Salice, Carimate, Italy

[73] Assignee: Arturo Salice S.p.A., Novedrate, Italy

[21] Appl. No.: 08/977,098

[22] Filed: Nov. 24, 1997

[30] Foreign Application Priority Data

Nov. 29, 1996 [IT] Italy ..... M196U0779

[51] Int. Cl.[6] ..... E05D 5/00

[52] U.S. Cl. ..... 16/382; 16/383; 16/DIG. 43

[58] Field of Search ..... 16/235, 382, 383, 16/DIG. 43

[56] References Cited

U.S. PATENT DOCUMENTS

| | | | |
|---|---|---|---|
| 4,768,259 | 9/1988 | Rock et al. | 16/382 |
| 4,800,625 | 1/1989 | Salice | 16/DIG. 43 |
| 4,982,476 | 1/1991 | Salice | 16/382 |

*Primary Examiner*—Chuck Y. Mah
*Assistant Examiner*—Donald M. Gurley
*Attorney, Agent, or Firm*—Herbert Dubno

[57] ABSTRACT

A base plate for fixing a hinge arm on furniture is constituted by a support plate (2) which can be fixed to a support wall, a covering plate (3) at least partially covering the support plate and transversely guided thereon and having fixing devices for attaching the hinge arm. Pre-mounted fixing screws (23,23') are partially screwed in the holes (20,21) of the support plate (2) and go through oblong holes (15,16) provided in the covering plate (3). In order to let the covering plate be transversely moved, easily and by economical means, and in order to prevent the support plate from separating from the covering plate before the mounting of the base plate, one hole (20) of the support plate (2) is at least partially surrounded by guide sockets (24) that go through the corresponding oblong hole (15) of the covering plate and slightly protrude from its upper edge. The thread diameter of the fixing screws (23) is greater than the width of the oblong holes (15) and keeps the support plate (2) in contact with the covering plate (3).

10 Claims, 6 Drawing Sheets

BASE PLATE FOR FIXING A FURNITURE HINGE OR THE LIKE

BACKGROUND OF THE INVENTION

1. Field of the Invention

The present invention relates to a base plate for fixing a furniture hinge or the like. The base plate is constituted by a support plate, provided with holes for fastening to a supporting wall, and by a covering plate which covers the support plate at least partially. The covering plate is transversely guided on the support plate and has fixing devices for the hinge arm. Pre-mounted fixing screws are partially screwed in the holes of the support plate and pass through oblong holes provided in the covering plate.

2. Description of the Prior Art

In a vertically adjustable plate of this type, disclosed by DE-U-8620441, the support plate is made of plastics and the holes of the support plate are at least partially surrounded by sockets partially passing through the oblong holes and forming guides for the sides of the oblong holes. In this manner the sockets of the support plate can be pressed into the central zone of the oblong holes of the covering plate. This centered fixing of the support plate is convenient because normally the holes in the supporting wall are located in an exact position and is therefore not necessary to subsequently adjust the height of the base plate which would require the loosening of the screws and a new tightening. Even though this conventional base plate is provided without pre-mounted fixing screws, there is a possibility that during shipping, or before mounting the plate, the support plate becomes separated from the covering plate, for example because of an accidental impact on the support plate, and the centered position is thus lost.

An aim of the present invention is to provide a base plate of the above type wherein the covering plate may be moved on the support plate in a simple and economic manner and wherein any undesired separation between the support plate and the covering plate before the mounting is prevented.

SUMMARY OF THE INVENTION

The above aim is achieved by a base plate of the above type characterized by claim 1 or 7.

In the base plate according to the invention, the covering plate may transversely slide on the support plate because the holes of the covering plate are oblong and the holes in the support plate are at least partially surrounded by sockets forming guides for the sides of the oblong holes. The sockets surrounding one of the holes of the support plate are shorter, so that as the sockets are introduced into one of the oblong holes the sockets end below its upper edge, while the sockets surrounding the other hole of the support plate protrude from the respective oblong hole in order to form a stop end for the screw head just above the surface of the covering plate.

On the side where the sockets slightly protrude above the surface of the covering plate, the covering plate is therefore held by the screw head still slidingly even after the fixing screw has been tightened, because of the slight play formed by the socket between the screw head and the surface of the covering plate.

For transversely moving the covering plate, it is sufficient to loosen only the fixing screw screwed in the hole of the support plate having the shorter socket since that screw head provides the fixing pressure. For fixing the covering plate, the same fixing screw has to be tightened while it is not necessary to operate the other screw. The fixing screw for the adjustment is conveniently identified by per se known identifier means.

In the base plate according to the invention, the support plate may be secured in contact with the covering plate in its centered position by means of the pre-mounted fixing screws only partially screwed in the support plate, because a section of the side of each thread rests on the upper area of the edge of the respective oblong hole, while the diametrally opposite area of the same thread is already in the support plate below the covering plate, because the pitch of the fixing screws is at least twice the thickness of the covering plate. Therefore, for the vertical adjustment, the covering plate may be moved on the support plate without hindrance because none of the threads dents the sides of the oblong holes. Furthermore, the fixing screws that are pre-screwed in the support plate, are secured in their vertical position so that the section of the side of the thread which is engaged and has a diameter larger than the width of the oblong holes, cannot slide down from the edge of the oblong hole possibly inclining the fixing screw. In this manner, the support plate is securely centered on the covering plate even on occasional impacts caused during shipping or before the assembly.

The centered position may be effected by means of only the pre-mounted fixing screws, that keep the support plate in contact by friction with the covering plate, while the sockets are guided without interference in the oblong holes, or also by means of the sockets surrounding the holes in the support plate and passing through the oblong holes in the covering plate, or still by means of the edges in the area of the side flaps in the shape of a flange. If however an adjustment is required, the covering plate may be moved on the support plate overcoming the friction force.

The covering plate of the base plate according to the invention may be made by stamping a sheet metal or by pressure die-casting (zamak) while the support plate is preferably made of plastics.

The holes for the fixing screws at the sockets of the support plate are conveniently provided with a hole section having a diameter corresponding to the core diameter of the fixing screws. This ensures that during the screwing of the fixing screws the material of the socket is not deformed and does not increase the friction along the sides of the oblong holes.

Conveniently, the fixing screw holes also have a deeper section having a diameter which is lesser than the core diameter of the fixing screws, in order to keep the fixing screws pre-mounted in the vertical position.

The fixing screws may be double-start screws so that the sides of both threads rest on the upper opposite zones of the oblong hole thus ensuring a firmer connection.

Preferably, the support plate is provided with spigots integral with the lower surface of the support plate and provided with holes aligned with the holes of the support plate. This assembly is particularly convenient when the base plate is provided pre-mounted on the hinge arm, because the door may be hooked on the supporting wall by inserting the spigots in the preset fixing holes before the fixing screws are completely screwed and have expanded the spigots.

According to a further embodiment of the invention, the support plate may be secured to the covering plate in a centered position by means of the threads of the pre-mounted fixing screws also dent the edges of the oblong holes of the covering plate. In this case, in a per se known manner, the fixing screws are provided with a thread free tang, or collar, below the head, having a diameter just lesser than the width of the oblong holes of the covering plate and having a height greater than the thickness of the oblong hole edges.

To ensure that the oblong holes are dented in thin edges by the threads, the fixing screws may be triple-start screws.

For vertically adjusting the base plate fixed on the supporting wall, it is sufficient to slightly loosen the fixing screw located at the lower socket so that the thread free tang or collar allows the covering plate to move transversely on the support plate of the desired distance, and then to re-tighten the same screw, while the head of the other screw, which is also provided with a thread free tang or collar, rests on the socket which is slightly protruding from the covering plate surface without blocking it, so that it is not necessary to operate this screw.

Conveniently, in this case, the support plate is made by die-casting or pressure die-casting a rigid material and the sockets are guided without interference in the oblong holes. The support plate may extend even below only one of the oblong holes of the covering plate and may be provided with the sockets protruding above the its upper surface. This particularly simple assembly ensures the connection of the covering plate still in a transversely sliding manner on the side of the plate above the support plate, while in the oblong hole located across it a screw is pre-mounted or pre-screwed, in a per se known manner, adapted to lock the covering plate on the supporting wall and which has to be loosened for the vertical adjustment.

BRIEF DESCRIPTION OF THE DRAWINGS

Embodiments of the invention are better illustrated in the enclosed drawings in which.

DESCRIPTION OF THE PREFERRED EMBODIMENTS OF THE INVENTION

Figure 1:
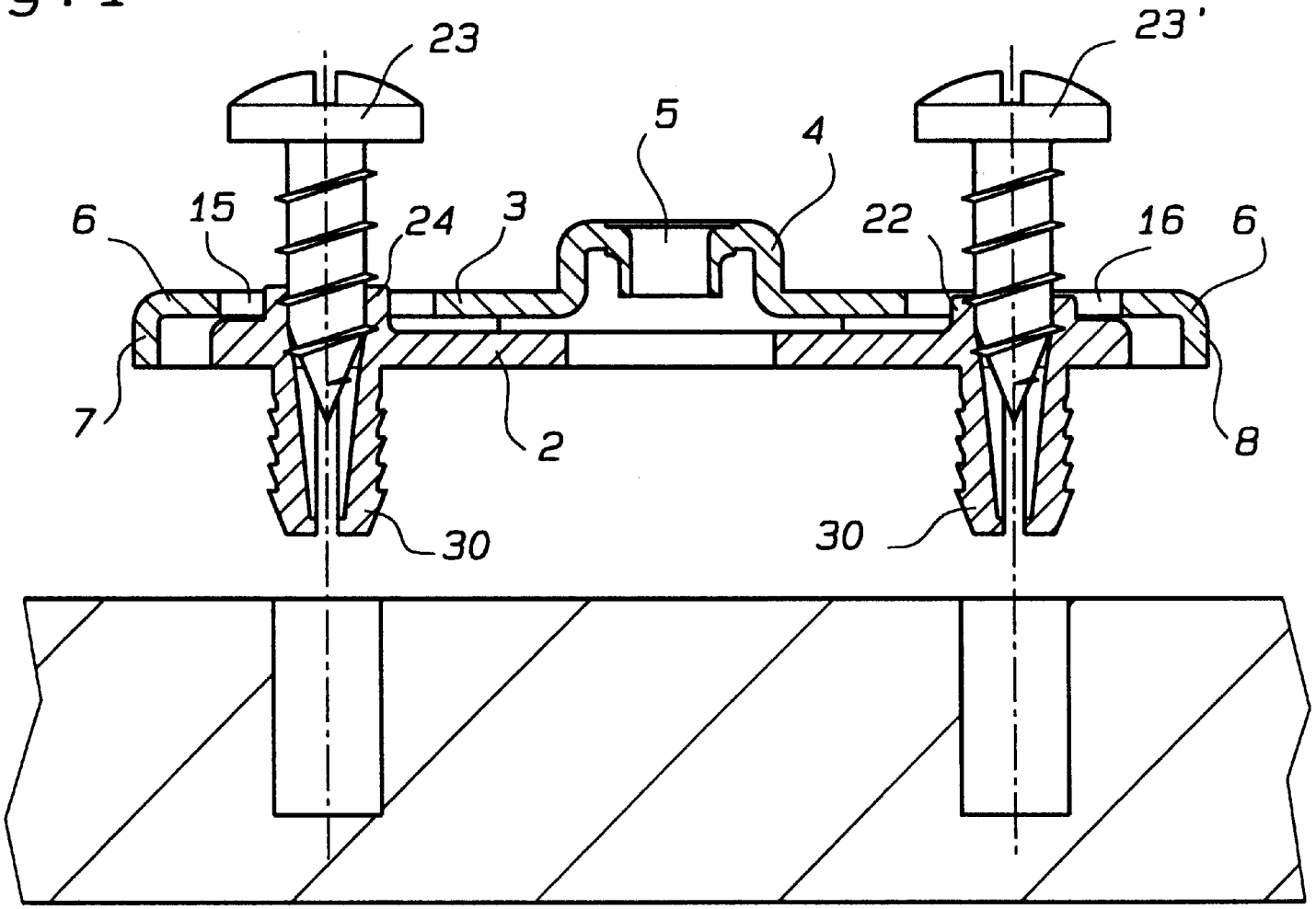
FIG. 1 is a section view, according to the line I—I of FIG. 2, of the base plate constituted by a support plate and by a covering plate with pre-mounted fixing screws and of the supporting wall provided with fixing holes.

The base plate illustrated in FIGS. 1–5 is constituted by a support plate 2, having a rectangular shape and rounded corners, and by a covering plate 3 completely covering the support plate.

The covering plate 3 is constituted by a punched sheet metal and has a U-shaped central zone 4 having the curve of the U towards the outside for holding the hinge arm. The covering plate 3 may also be provided by die-casting for example of zamak.

The hinge harm, which is not shown in the drawings, covers the fixing socket 4 with its sides. The fixing socket 4 is formed by the U-shaped profile which, in the illustrated example, at its central zone, is provided with a threaded hole 5 for the fixing screws of the hinge arm. The covering plate 3 may also be provided with per se known snap on means for fixing the hinge arm, which are therefore not illustrated in detail here.

The central median portion of the covering plate 3 forming a fixing socket 4 is provided with lateral flanges 6 for fixing the base plate to a supporting wall or similar. These lateral protrusions are provided with an downward edge 7,8 extending on the adjacent lateral zones 9,10,11,12 of the central portion.

The covering plate 3 is symmetrically shaped with respect of its longitudinal axis and to its transversal axis I—I, so that the base plate 1 is adapted to both a left or right connection to the hinge.

The lateral flanges 6 of the covering plate 3 are provided with oblong holes 15,16 having axes aligned with the transversal axis I—I.

Figure 2:
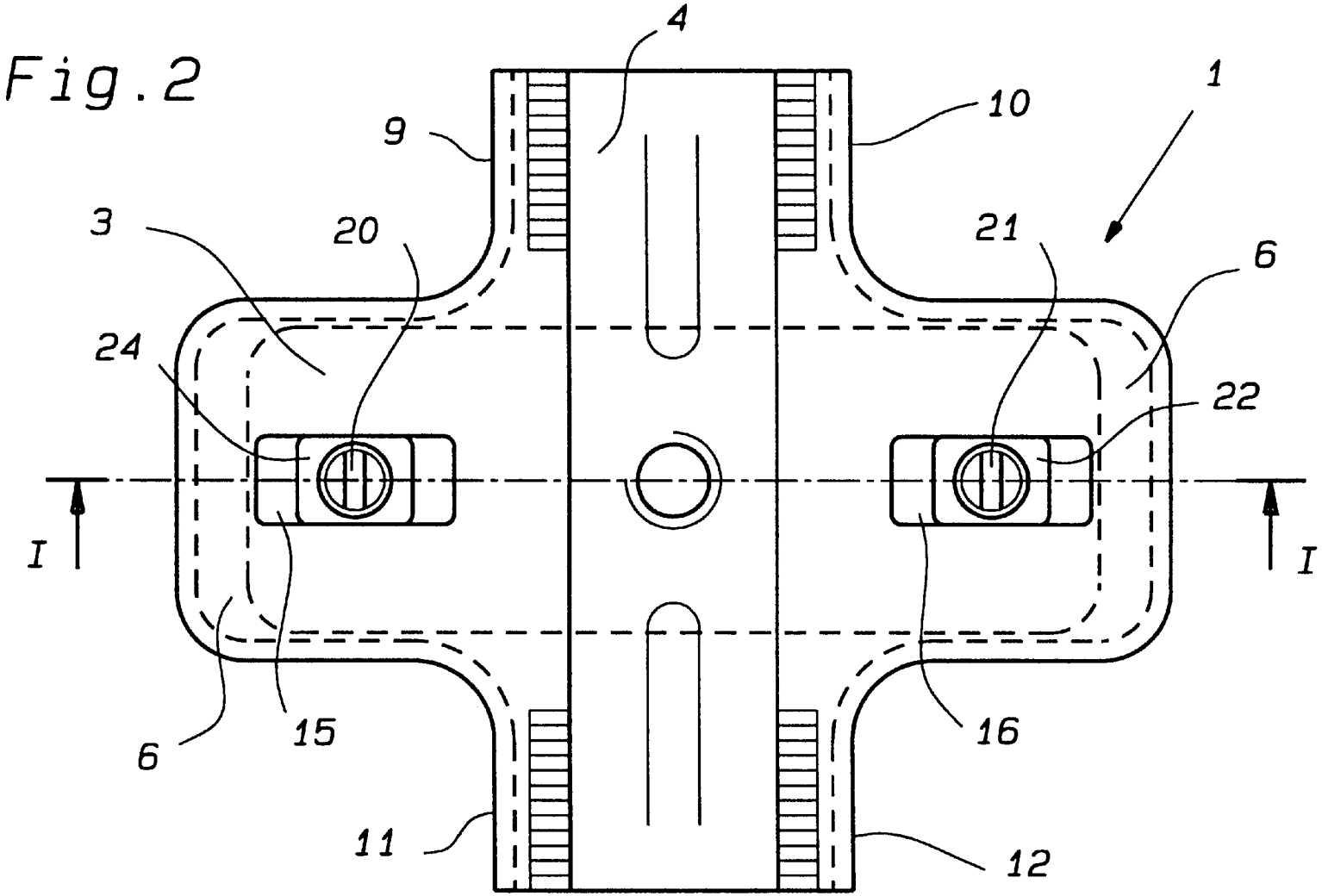
FIG. 2 is an upper view of the base plate of FIG. 1 where the fixing screws are not pre-mounted.
Figure 5:
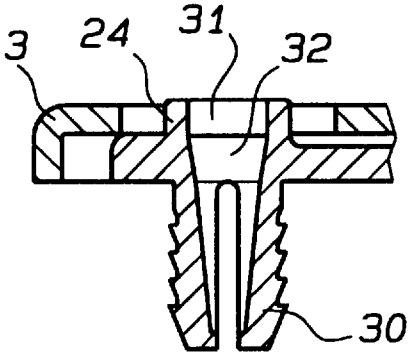
FIG. 5 is a partial section view of the base plate corresponding to FIG. 1 without the fixing screw on the side provided with protruding socket.
Figure 4:
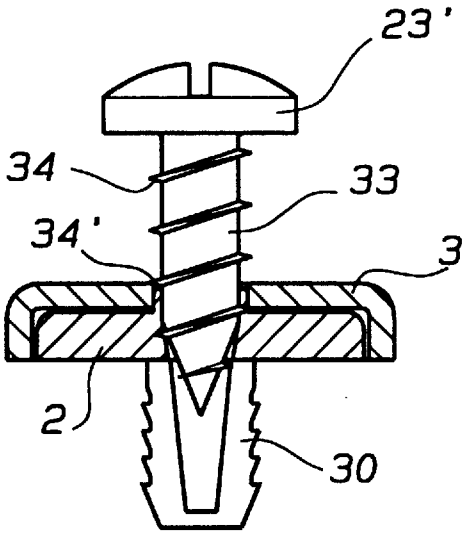
FIG. 4 is a sectional view according to the line IV—IV of FIG. 3.
Figure 3:
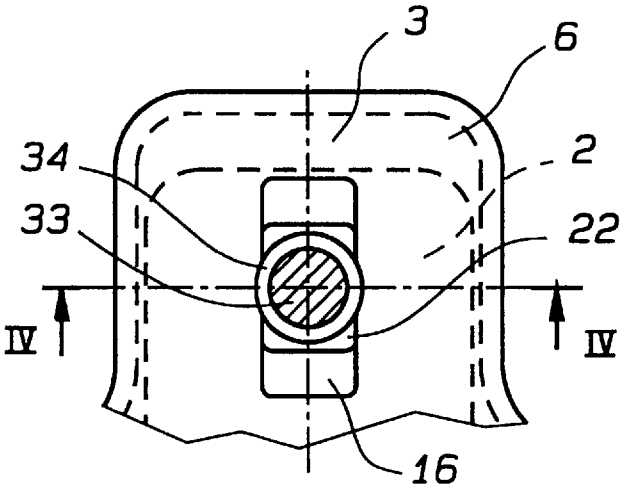
FIG. 3 is an upper view of the base plate provided with the oblong hole with a sectioned fixing screw.

The support plate 2 has a substantially rectangular shape and is covered, as shown in FIGS. 1 and 2, by the bent edges 7,8 of the lateral protrusions or flanges 6 of the covering plate 3. The terminal zones of the covering plate are provided with holes 20,21 located on its longitudinal axis which coincides with the transversal axis I—I of the covering plate. Holes 20,21 are adapted to receive the fixing screws 23,23'. Holes 20,21 are surrounded by raised portions 22,24 in the form of sockets having a rectangular shape, from a top plan view, and in the mounted position are laterally surrounded by the sides of the oblong holes 15,16 of the covering plate 3. Socket 22 has a lower height than the thickness of covering plate 3 and therefore does not completely pass the oblong hole 16. Socket 24 has a height slightly greater than the thickness of the covering plate 3 and therefore protrudes from the oblong hole 15 of a sufficient extent in order to avoid the pressure of the head of fixing screw 23 on the covering plate 3. The length of sockets 22,24 is lesser than that of oblong holes 15,16, as apparent from FIGS. 1 and 2, so that the covering plate 3 may be moved on the support plate along the transversal axis I—I, where the sides of sockets 22,24 at the sides of the oblong holes 15,16 act as guides. For allowing a transversal motion of the covering plate 3, the support plate 2, in the median portion, end at a distance from the bent edges 7,8 of the covering plate 3, as shown by the contour broken lines in FIG. 2.

The support plate 2 is made of an adapted material. In the illustrated example, the support plate 2 is made in one piece by injection molded plastics and has spigots 30 on its lower surface in the area of holes 20,21. The axes of the spigots 30 coincide with the axes of the holes. In a per se known manner, the spigots are provided with counterposed longitudinal slots and with a saw teeth profile on their external perimetric surface.

In the area of the sockets 22,24, the holes 20,21 have sections 31 having a diameter about corresponding to the core diameter 33 of the fixing screws 23. This hole section 31 is followed by a hole section 32 having a diameter downwardly tapered and which can be dented by the thread 34 of the fixing screws 23,23' during pre-mounting.

In the pre-mounting, the fixing screws 23,23' are guided with their core 33 in the first hole section 31 in a direction exactly perpendicular to the covering plate 3 and are only partially screwed in the second hole section 32. In this manner the screws are secured in the vertical position without expanding the sockets 30.

The fixing screws 23,23' have threads 34 with a greater inclination or pitch than the thickness of the covering plate 3. The inclination or angle of the thread 34 of the fixing screws is such as the distance between two successive thread crests is at least twice the thickness of the covering plate 3 in the area of the edges of the oblong holes 15,16.

During the pre-mounting operation, a portion of the side 34' of thread 34 rests on an upper zone of the edge of the oblong holes 15,16 while the portion of the side 34 of the thread which is diametrally opposite is dented in the support plate 2 below the covering plate 3. The diameter of the thread 34 is greater than the width of the oblong holes 15,16 while the core diameter of the tang 33 of the screws is preferably lesser than the width of the oblong holes 15,16 so that a side of the thread is securely rested on a zone of the edge of the oblong holes 15,16 with fixing screws that are vertically held in the holes of the support plate.

Since because of the great inclination of the threads 34 of the fixing screws 23,23', the threads cannot dent the sides of the oblong holes 15,16, the covering plate 3 may still be moved transversely on the support plate in the longitudinal direction of the oblong holes, before the fixing screw 23' is completely tightened.

Since the diameter of the thread of the fixing screws 23,23' is greater than the width of the oblong holes 15,16, the support plate 2 is held in contact with the covering plate 3, because the fixing screws are held in vertical position in the fixing holes of the support plate and therefore the threads cannot enter through the oblong holes. In the same manner, if an impact is accidentally imparted to the fixing screws, there is still no separation between the covering plate and the support plate and the centered position is maintained.

In a preferred embodiment of the invention, the fixing screws are two star screws with the above described pitch.

This assembly ensures that the respectively counterposed sides of both threads rest on the counterposed upper zones of the edges of the oblong holes of the covering plate, thereby ensuring a symmetrical support and a more secure connection between the covering plate and the support plate.

The base plates illustrated in FIGS. 6–10 are structurally similar to the preceding ones and therefore like reference characters denote similar features.

Figure 6:
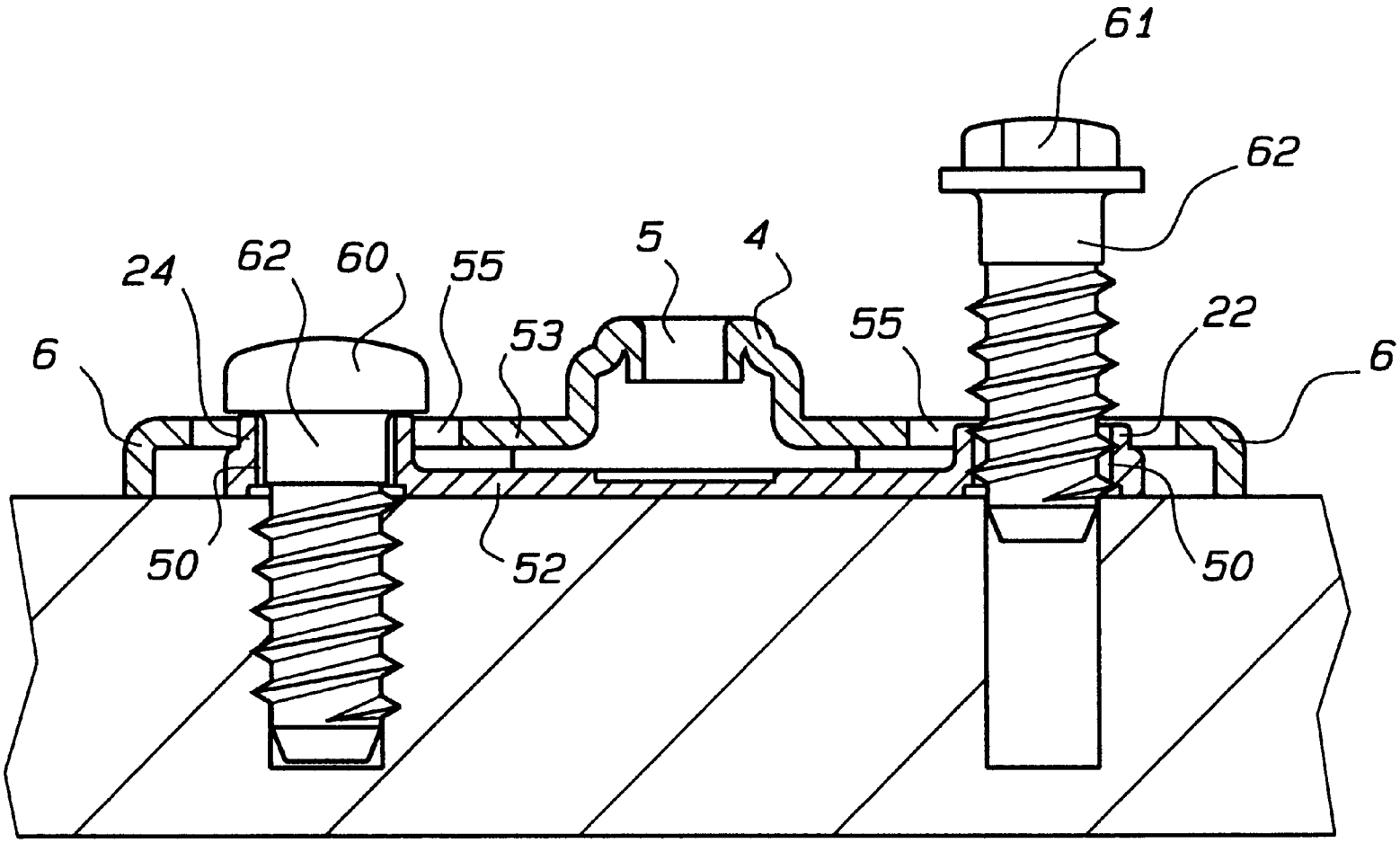
FIG. 6 is a section view corresponding to FIG. 1 of a second embodiment of the base plate having a pre-mounted screw and a screw resting on the protruding sockets of the support plate.
Figure 7:
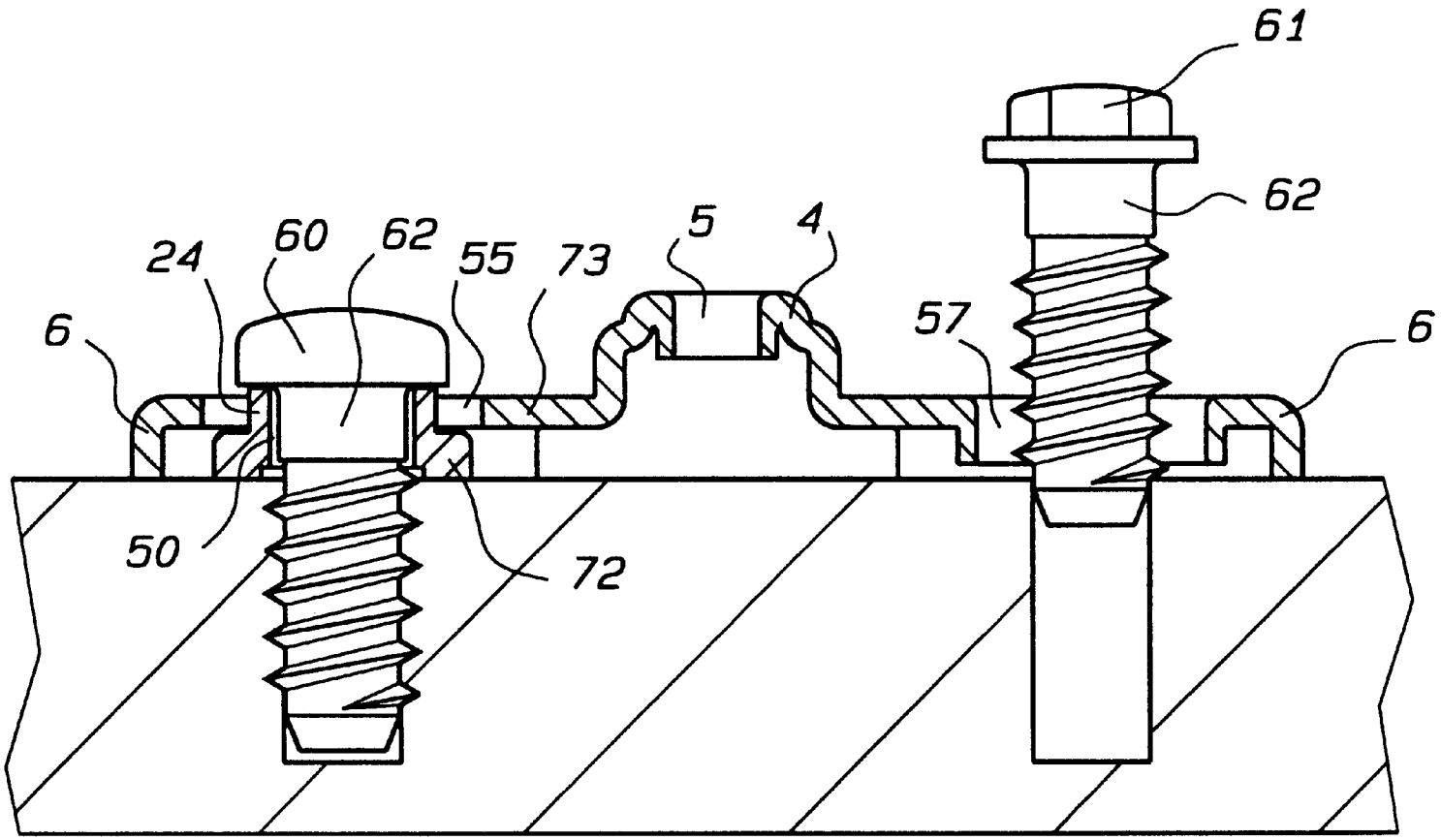
FIG. 7 is a section view corresponding to FIG. 6 of a third embodiment of the base plate wherein the support plate is limited to the zone of only one oblong hole of the covering plate.
Figure 9:
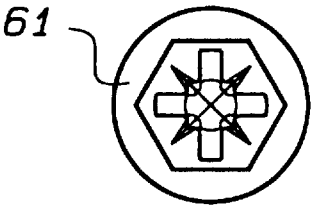
FIG. 9 is an upper view of the fixing screw with shaped head.
Figure 10:
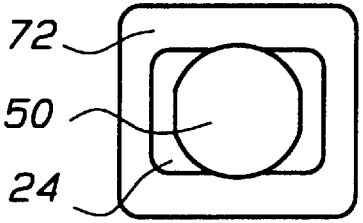
FIG. 10 is an upper view of the base plate of FIG. 7.

The covering plate 53 of the base plate illustrated in FIG. 6 is provided with identical oblong holes 55 on the lateral flanges 6. The support plate 52 is provided with holes 50 having a diameter slightly lesser than the diameter of the thread of the fixing screws 60,61 an surrounded by raised portions 22,24, in the form of sockets, only on counterposed portions.

The width of the sockets 22,24 is slightly lesser than that of the oblong holes 55 allowing the covering plate 53 to move transversely on the support plate 52 without interference.

The support plate is preferably made of a rigid material, for example zamak.

Below their heads, the fixing screws 60,61 are provided with a thread free tang or collar portion 62 having a diameter lesser than the width of the oblong holes 55 and having a height greater than the thickness of their edges. Their thread has a pitch lesser than twice the thickness of the covering plate 53 and may be a three start screw in order to ensure the denting of the oblong holes 55 even if these holes have a small thickness.

During the pre-mounting operation of the base plate, the threads of the fixing screws 60,61 dent both the edges of the oblong holes 55 of the covering plate 53 comprised between the counterposed socket portions, and the counterposed walls of the sockets 22,24 of the support plate 52, in the manner apparent from FIG. 6, thus keeping joined together the plates 52,53 in the centered position.

The sockets 22,24 guide the fixing screws that are only partially screwed in a perpendicular direction to the base plate.

Just before the complete tightening of the fixing screws 60,61, the oblong holes 55 are crossed, as apparent from the left hand side of FIG. 6, by the thread free tang or collar portion 62, so that the covering plate 53 is no longer held and is free to move transversely on the support plate 52 for the vertical adjustment. The desired position is fixed by tightening the fixing screw 61 which, in the illustrated example, is provided with a hexagonal shaped head in order to be identified, as better illustrated in FIG. 9.

In the base plate illustrated in FIGS. 7–10, the support plate 72 does not cross the fixing socket 4 of the covering plate 73 but rather extends only below the oblong hole 55. The support plate 72 is provided with a hole 50 surrounded by higher sockets 24 on counterposed portions, in a manner identical to the left hand side of the support plate of FIG. 6.

Figure 8:
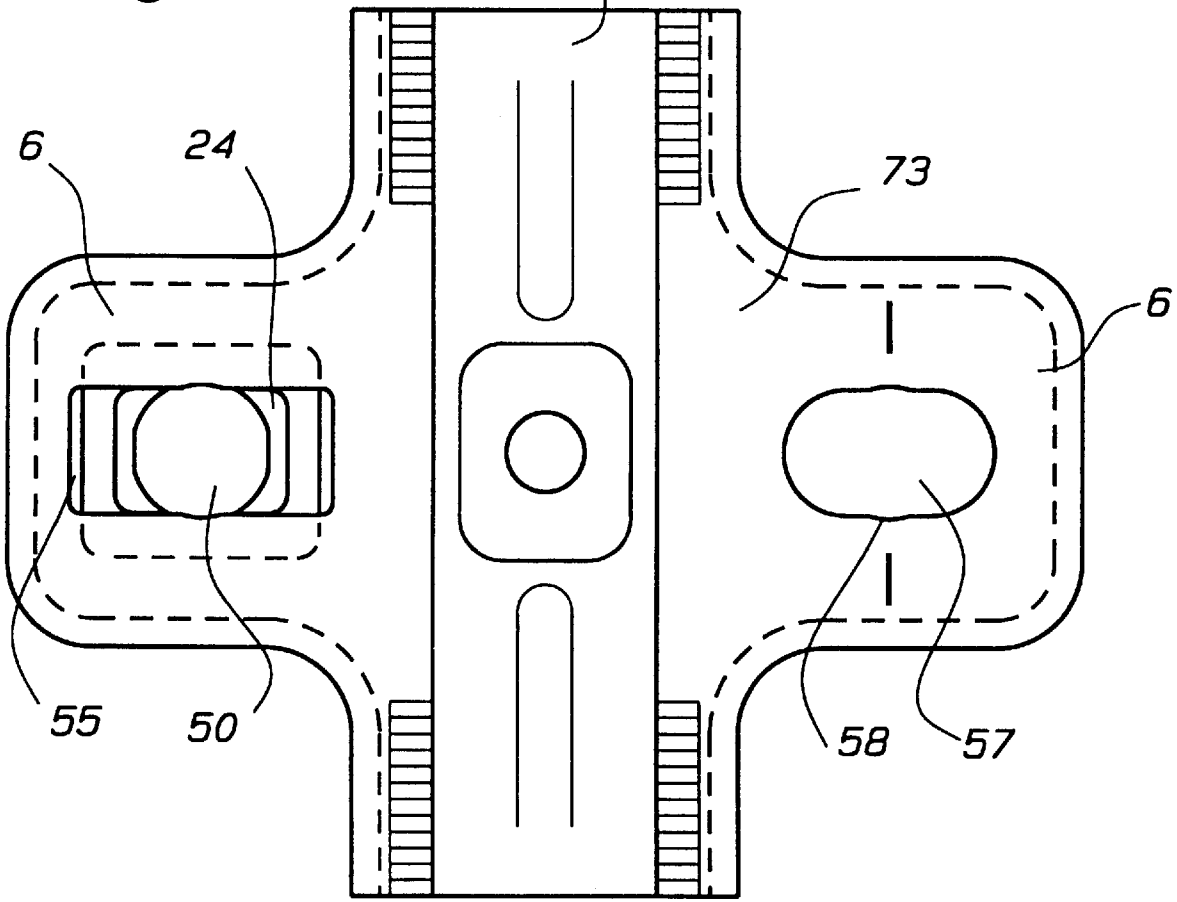
FIG. 8 is an upper view of the base plate of FIG. 7 without the pre-mounted fixing screws.

On the right hand side lateral flange 6 of FIG. 8, which is counterposed to the fixing socket 4, the covering plate 73 is provided with a per se known oblong hole where a fixing screw may be pre-mounted or screwed. In the illustrated example, the covering plate 73 is provided with a downwardly edged hole 57 having central flattened portions 58 for the central pre-mounting of the fixing screw 61, as better illustrated in FIG. 7.

I claim:

1. A base plate for mounting a hinge arm on furniture comprising a support plate provided with holes for receiving fixing screws, which can be fixed to a support wall, a covering plate at least partially covering said support plate and transversely guided thereon and having fixing devices for mounting the hinge arm, wherein pre-mounted fixing screws are partially screwed in said holes of the support plate and go extend through oblong holes provided in said covering plate, said holes of said support plate being at least partially surrounded by guide sockets that at least partially extend through one of said oblong holes and slightly protrude from an upper edge of the cover plate surrounding the other oblong hole, the thread diameter of the fixing screws being slightly greater than the width of the oblong holes and the thread pitch of the fixing screws being at least twice the thickness of the edges surrounding the oblong holes so that a section of the side of each thread makes contact with the upper edge surrounding the oblong holes and thereby keeps the support plate in contact with the covering plate.

2. The base plate, according to claim 1, wherein said holes for said fixing screws at said sockets of the support plate are provided with a hole section having a diameter corresponding to the core diameter of said fixing screws.

3. The base plate, according to claim 2, wherein the holes for said fixing screws are provided with a further hole section located more deeply having a diameter which is lesser than the core diameter of said fixing screws.

4. The base plate, according to claim 3, wherein the thread (inclination) pitch of the fixing screws corresponds to twice the thickness of the covering plate in the zone of the oblong holes.

5. The base plate, according to claim 4, characterized in that said fixing screws are two start screws.

6. The base plate, according to claim 5, wherein the lower surface of said support plate is provided with integral spigots having holes aligned with the holes of the support plate.

7. A base plate for mounting a hinge arm on furniture comprising a support plate for fixing screws, which can be fixed to a support wall, a covering plate at least partially covering said support plate and transversely guided thereon and having fixing devices mounting the hinge arm, wherein pre-mounted fixing screws are partially screwed in holes of the support plate and extend through oblong holes provided in the covering plate, said holes of said support plate being surrounded by guide sockets of different lengths defining short and long sockets, the lower sockets partially going through one of said oblong holes and the long sockets slightly protruding from the upper edge of the other oblong hole, the thread diameter of the fixing screws being greater than the width of the oblong holes and the fixing screws are provided, below their heads, with a thread free tang or collar section having a diameter which is less than the width of the oblong holes and having a height which is greater than the thickness of their edges surrounding the oblong holes.

8. The base plate, according to claim 7, wherein said fixing screws are three start screws.

9. The base plate, according to claim 8, wherein said support plate is made of a rigid material by stamping or pressure die-casting and said sockets are guided without interference in said oblong holes.

10. The base plate, according to claim 9, wherein said support plate extends below only one of said oblong holes of the covering plate and is provided with sockets protruding above its upper surfaces.

* * * * *